United States Patent [19]

Nishimura

[11] 4,417,544

[45] Nov. 29, 1983

[54] DEVELOPING DEVICE

[75] Inventor: Fuminobu Nishimura, Yokohama, Japan

[73] Assignee: Tokyo Shibaura Denki Kabushiki Kaisha, Kanagawa, Japan

[21] Appl. No.: 404,492

[22] Filed: Aug. 2, 1982

[30] Foreign Application Priority Data

Aug. 5, 1981 [JP] Japan ..... 56-116514[U]
Aug. 5, 1981 [JP] Japan ..... 56-116515[U]

[51] Int. Cl.[3] ..... B05B 7/06
[52] U.S. Cl. ..... 118/688; 118/311
[58] Field of Search ..... 118/688, 311

*Primary Examiner*—Bernard D. Pianalto
*Attorney, Agent, or Firm*—Cushman, Darby & Cushman

[57] ABSTRACT

A developing device supplies red toner and black toner to a photosensitive layer. The developing device comprises a toner resupply mechanism which is attached to a receptacle to replenish selectively the shortage of the red or black toner in the receptacle corresponding to consumption thereof. The toner resupply mechanism includes a housing having a connecting port connecting the receptacle and first and second chambers to store therein the red and black toners, respectively. A roller for resupply is reversibly rotatably disposed in the connecting port.

6 Claims, 11 Drawing Figures

DEVELOPING DEVICE

BACKGROUND OF THE INVENTION

The present invention relates to a developing device used in an electronic copying apparatus, more specifically to a developing device capable of supplying developers of two different kinds.

In the field of electronic copying apparatuses, there have recently been provided developing devices in which developers of two different kinds, e.g., developers with two different colors, are stored in a receptacle, and are selectively supplied to an electrostatic latent image formed on a photosensitive layer so that the image may be developed in two colors.

With use of one such conventional developing device, the quantity of one developer supplied for developing operation may be different from that of the other. Accordingly, the ratio between the quantities of the two developers stored in the receptacle varies as the developing operation advances. Namely, one developer may be used up, while the other remains in the receptacle. Further, the change of the ratio in quantity may exert a bad influence upon picture density. Thus, it is necessary to supply the developers individually on the basis of their consumption during the developing operation.

To meet this requirement, the prior art developing device is so constructed that resupply hoppers are provided individually for the developers, and have their respective supply rollers. In such an arrangement, required quantities of the developers are fed individually into the receptacle by selectively rotating the supply rollers on the basis of the consumption of the developers or the residual quantities thereof in the receptacle.

Having such construction, the prior art developing device is bulky and requires a wide setting space, thus leading to an increase in size of the copying apparatus. The conventional device also requires a substantial number of components or members, resulting in an increase in cost.

SUMMARY OF THE INVENTION

The present invention is contrived in consideration of the above-mentioned circumstances, and is intended to provide a developing device simple in construction and capable of balancing the quantities of developers in a receptacle.

According to an aspect of the present invention, there is provided a developing device which supplies first and second developers to a photosensitive layer formed on the surface of a photosensitive body, comprising a receptacle facing the photosensitive layer to store the first and second developers therein, supply means in the receptacle for supplying the first and second developers to the photosensitive layer, and developer resupply means attached to the receptacle to supply selectively the shortage of the first or second developer in the receptacle corresponding to the consumption thereof, the developer resupply means including a housing having a port connecting the receptacle, the housing having first and second storage chambers to store therein the first and second developers, respectively, the first and second storage chambers connected with the port, a rotating body for resupply rotatably disposed at the connection port, the rotating body having a first portion located inside the first storage chamber, a second portion located inside the second storage chamber, and a third portion located inside the receptacle, and first drive means connected with the rotating body for driving the rotating body selectively to rotate in one direction or in the other direction opposite thereto, the rotating body supplying the first developer from the first storage chamber to the receptacle when rotated in the one direction, and supplying the second developer from the second storage chamber to the receptacle when rotated in the other direction.

DETAILED DESCRIPTION OF THE PREFERRED EMBODIMENT

There will now be described a developing device used in an electronic copying apparatus according to one embodiment of the present invention with reference to the accompanying drawings.

Figure 1:
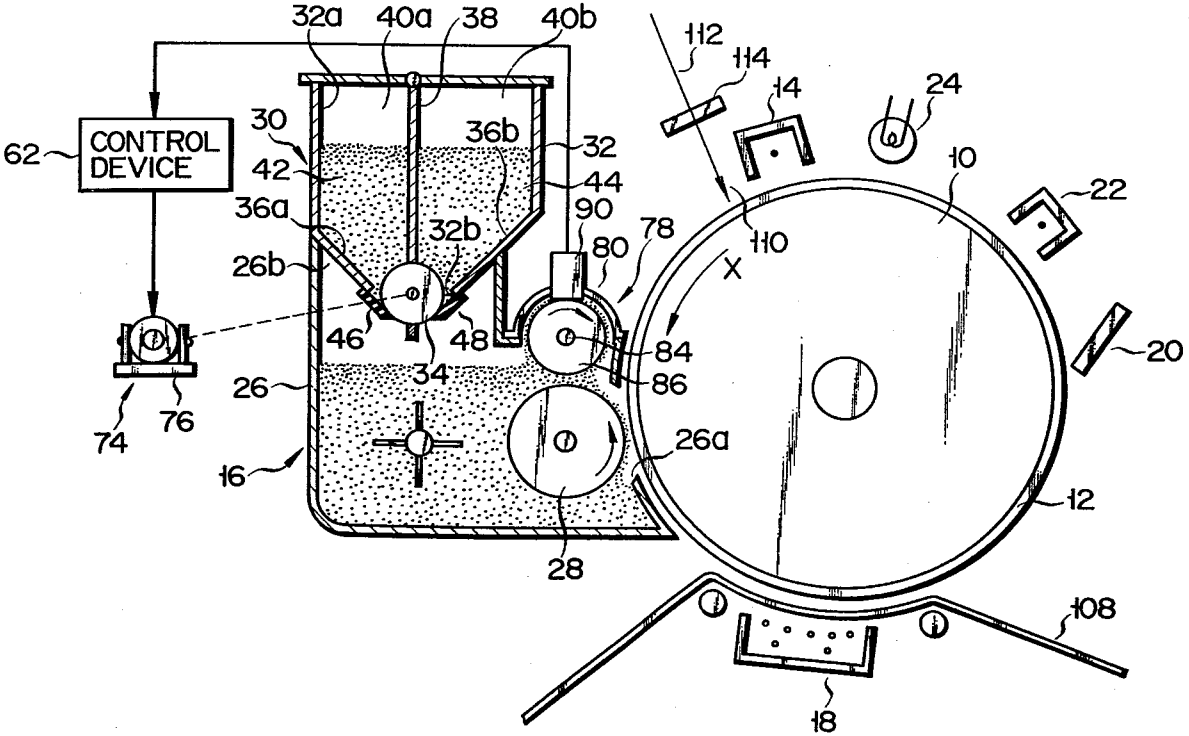
FIG. 1 is a front view schematically showing a developing device according to one embodiment of the present invention applied to an electronic copying apparatus.

In FIG. 1, numeral 10 designates a photosensitive drum which is rotatably disposed in the electronic copying apparatus. The photosensitive drum 10 is driven by a drive mechanism (not shown) to rotate in the counterclockwise direction indicated by an arrow X of FIG. 1. Laid on the outer peripheral surface of the photosensitive drum 10 is a photosensitive layer 12 containing e.g. CdS on which a positive or negative surface potential is formed selectively as required. Surrounding the photosensitive drum 10, a charger 14, a developing device 16, a transfer device 18, a cleaning device 20, a discharger 22, and a lamp 24 for electric discharge are arranged successively along the rotating direction of the photosensitive drum 10. The charger 14 can selectively charge the photosensitive layer 12 of the photosensitive drum 10 with positive or negative electricity. The cleaning device 20 can be moved by a shifting mechanism (not shown) between a position in contact with the photosensitive layer 12 and a position off the photosensitive layer 12. In the position in contact with the photosensitive layer 12, the cleaning device 20 removes toner and cleans the developer remaining on the photosensitive layer 12. In the position off the photosensitive layer 12, the cleaning device 20 is prevented from cleaning the photosenstive layer 12.

The above-mentioned developing device 16 is provided with a receptacle 26 which is located close to the left side portion of the outer peripheral surface of the photosensitive drum 10. Openings 26*a* and 26*b* are formed at the right and upper side portions of the receptacle 26, respectively. A single developing roller 28 as supply means is set in the receptacle 26 so as to be rotatable about an axis parallel to the rotation axis of the photosensitive drum 10. The right side portion of the developing roller 28 faces the photosensitive layer 12 through the opening 26*a*, while the remaining large portion is located within the receptacle 26. The developing roller 28 is driven to rotate counterclockwise by a drive mechanism (not shown).

A developer supply mechanism 30 is attached to the upper portion of the receptacle 26 so as to close the opening 26*b*. The developer supply mechanism 30 includes a housing 32 which has an opening 32*a* covering the whole area of the top, and a supply port 32*b* formed substantially in the center of the lower portion thereof. A supply roller 34 is located in the supply port 32*b* of the housing 32 so as to be rotatable about an axis parallel to the rotation axis of the photosensitive drum 10. The opening 32*b* divides the bottom plate of the housing 32 into two portions, that is, first and second bottom plate portions 36*a* and 36*b*. The first and second bottom plate portions 36*a* and 36*b* are angled down toward the central portion of the bottom plate. The outer peripheral surface of the supply roller 34 is spaced from the respective end edges of the first and second bottom plate portions 36*a* and 36*b* which define both end edges of the opening 32*b* to face the roller 34.

A partition wall 38 vertically extends into the housing 32 to divide the inside space thereof into right and left halves. The lower end edge of the partition wall 38 abuts against the upper end portion of the outer peripheral surface of the supply roller 34. The left-hand half of the inside space divided by the partition wall 30 is defined as a first storage chamber 40*a*, while the right-hand half is defined as a second storage chamber 40*b*. The first and second storage chambers 40*a* and 40*b* adjoin each other and are isolated from each other by the partition wall 38 and the supply roller 34. A first toner 42 as a first developer is stored in the first storage chamber 40*a*, and a second toner 44 as a second developer is stored in the second storage chamber 40*b*. The first toner 42 has a positive charge polarity and a red color, while the second toner 44 has negative charge polarity and a black color.

Figure 2:
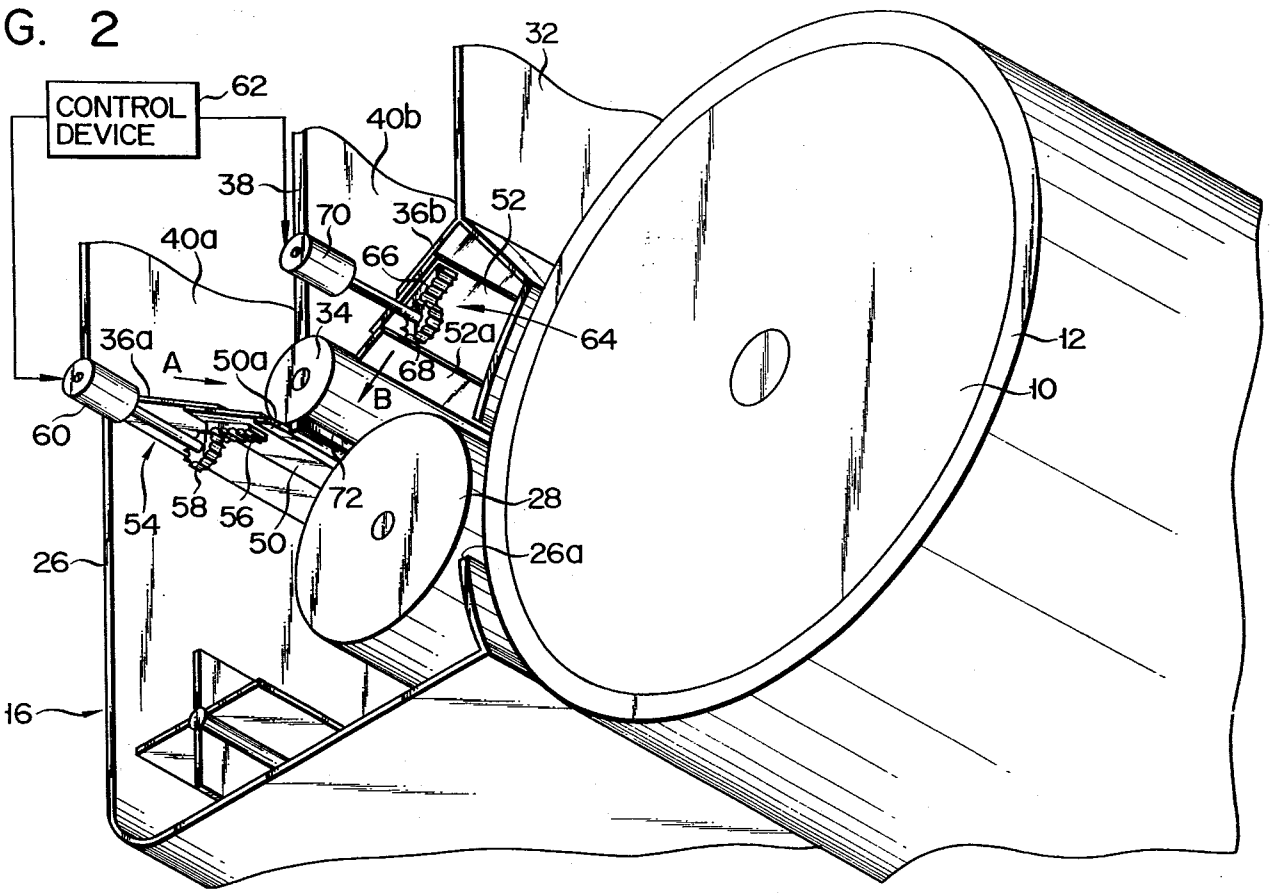
FIG. 2 is a bottom perspective of the developing device.

The first bottom plate portion 36*a* is provided with a first shutter mechanism 46 capable of closing the gap between the portion 36*a* and the supply roller 34. Likewise, the second bottom plate portion 36*b* is provided with a second shutter mechanism 48 capable of stopping up a gap between the portion 36*b* and the supply roller 34. As shown in FIG. 2, the first shutter mechanism 46 includes a first shutter member 50 slidable in the direction indicated by an arrow A along the underside of the first bottom plate portion 36*a*. A first contact strip 50*a* made of an elastic material, such as rubber, is fixed to the forward end of the first shutter member 50. The first shutter member 50 can move between a first position where the forward end of the first contact strip 50*a* presses on the outer peripheral surface of the supply roller 34*a* and a second position where the forward end is off the outer peripheral surface of the supply roller 34. When the first shutter member 50 is in the first position, the first storage chamber 40*a* is disconnected from the receptacle 26. When the first shutter member 50 is in the second position, the first storage chamber 40*a* is connected with the receptacle 26.

The second shutter mechanism 48 includes a second shutter member 52 slidable in the direction indicated by an arrow B along the underside of the second bottom plate portion 36*b*. A second contact strip 52*a* made of an elastic material, such as rubber, is fixed to the forward end of the second shutter member 52. The second shutter member 52 can move between a third position where the forward end of the second contact strip 52*a* presses on the outer peripheral surface of the supply roller 34 and a fourth position where the forward end is off the outer peripheral surface of the supply roller 34. When the second shutter member 52 is in the third position, the second storage chamber 40*b* is disconnected from the receptacle 26. When the second shutter member 52 is in the fourth position, the second storage chamber 40*b* is connected with the receptacle 26.

The first shutter member 50 is connected with a first drive mechanism 54 for driving it between the first and second positions. The first drive mechanism 54 includes a first rack 56 fixed to the underside of the first shutter member 50 and extending in the direction indicated by the arrow A, a pinion 58 in mesh with the first rack 56, and a first motor 60 to rotate the pinion 58. The first motor 60 is a reversible motor whose rotating direction is controlled by a control device 62 mentioned later.

The second shutter member 52 is connected with a second drive mechanism 64 for driving it between the third and fourth positions. The second drive mechanism 64 includes a second rack 60 fixed to the underside of the second shutter member 52 and extending in the direction indicated by the arrow B, a pinion 68 in mesh with the second rack 66, and a second motor 70 to rotate the pinion 68. The second motor 70 is a reversible motor whose rotating direction is controlled by the control device 62.

A blade 72 for scraping off the toner into the receptacle 26 is arranged in slide contact with the lower end portion of the outer peripheral surface of the supply roller 34. The blade 72 extends along the longitudinal direction of the supply roller 34. As shown again in FIG. 1, the supply roller 34 is connected with a third drive mechanism 74 for rotating it. The third drive mechanism 74 is provided with a reversible third motor 76. The third motor 76 is also connected with the control device 62, which determines the rotating direction of the third motor 76.

Figure 3:
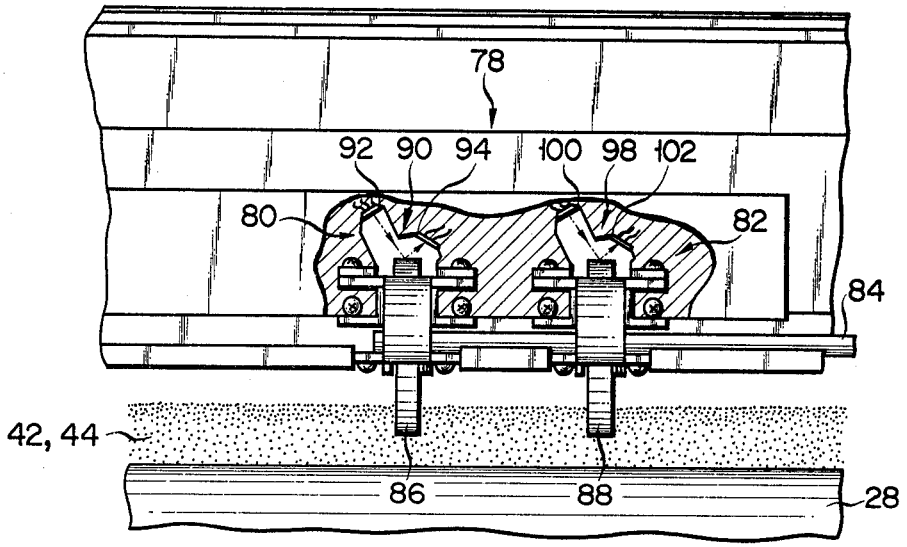
FIG. 3 is a side view extractively showing a detection mechanism.

Over the developing roller 28 in the receptacle 26 lies a detection mechanism 78 for detecting the respective quantities of the first and second toners 42 and 44 mixedly stored in the receptacle 26. As shown in FIG. 3, the detection mechanism 78 includes a first detecting section 80 for detecting the first toner 42 and a second detecting section 82 for detecting the second toner 44 arranged at a space along the axial direction of the developing roller 28.

The first and second detecting sections 80 and 82 have first and second detecting rollers 86 and 88, respectively, fixed spaced and to a common driving shaft 84 with a rotation axis parallel to the rotation axis of the developing roller 28. The common driving shaft 84 is rotated by a drive mechanism (not shown) in the clockwise direction of FIG. 1, so that the first and second detecting rollers 86 and 88 are rotated in the same direction.

Figure 4:
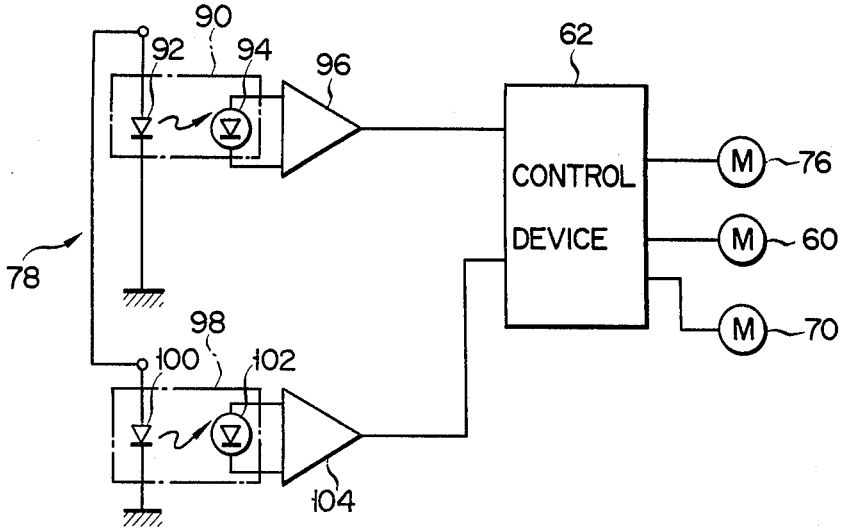
FIG. 4 is a wiring diagram showing the connection between photo-couplers of the detection mechanism and a control device.

The first detecting section 80 is provided with a first photo-coupler 90 located over the first detecting roller 86. The first photo-coupler 90 includes a first light emitting diode 92 to emit light rays toward the upper end portion of the outer peripheral surface of the first detecting roller 86, and a first light receiving element 94 which receives reflected light rays from the upper end portion and delivers an electric signal at a level corresponding to the intensity of the light rays received. As shown in FIG. 4, the first light receiving element 94 is connected with the control device 62 through a first amplifier 96.

On the other hand, the second detecting section 82 is provided with a second photo-coupler 98 located over the second detecting roller 88. The second photo-coupler 98 includes a second light emitting diode 100 to emit light rays toward the upper end portion of the outer peripheral surface of the second detecting roller 88, and a second light receiving element 102 which receives reflected light rays from the upper end portion and delivers an electric signal at a level corresponding to the intensity of the light rays received. The second light receiving element 102 is connected with the control device 62 through a second amplifier 104.

The lower portions of the outer peripheral surfaces of the first and second detecting rollers 86 and 88 are so located as to be buried in the mixed toners 42 and 44 in the receptacle 26. The outer peripheral surface of the first detecting roller 86 is covered with a coating material, such as aniline resin, which is positively charged when touched by the toner. Accordingly, only the black second toner 44 is adsorbed on the outer peripheral surface of the first detecting roller 86. The adsorbed second toner 44 is carried upward as the first detecting roller 86 rotates. Thus, the quantity of the second toner 44 is independently detected by the first detecting section 80.

On the other hand, the outer peripheral surface of the second detecting roller 88 is covered with a coating material which is negatively charged when touched by toner. Accordingly, only the red first toner 42 is adsorbed on the outer peripheral surface of the second detecting roller 88. The adsorbed first toner 42 is carried upward as the second detecting roller 88 rotates. Thus, the quantity of the first toner 42 is independently detected by the second detecting section 82.

Figure 5:
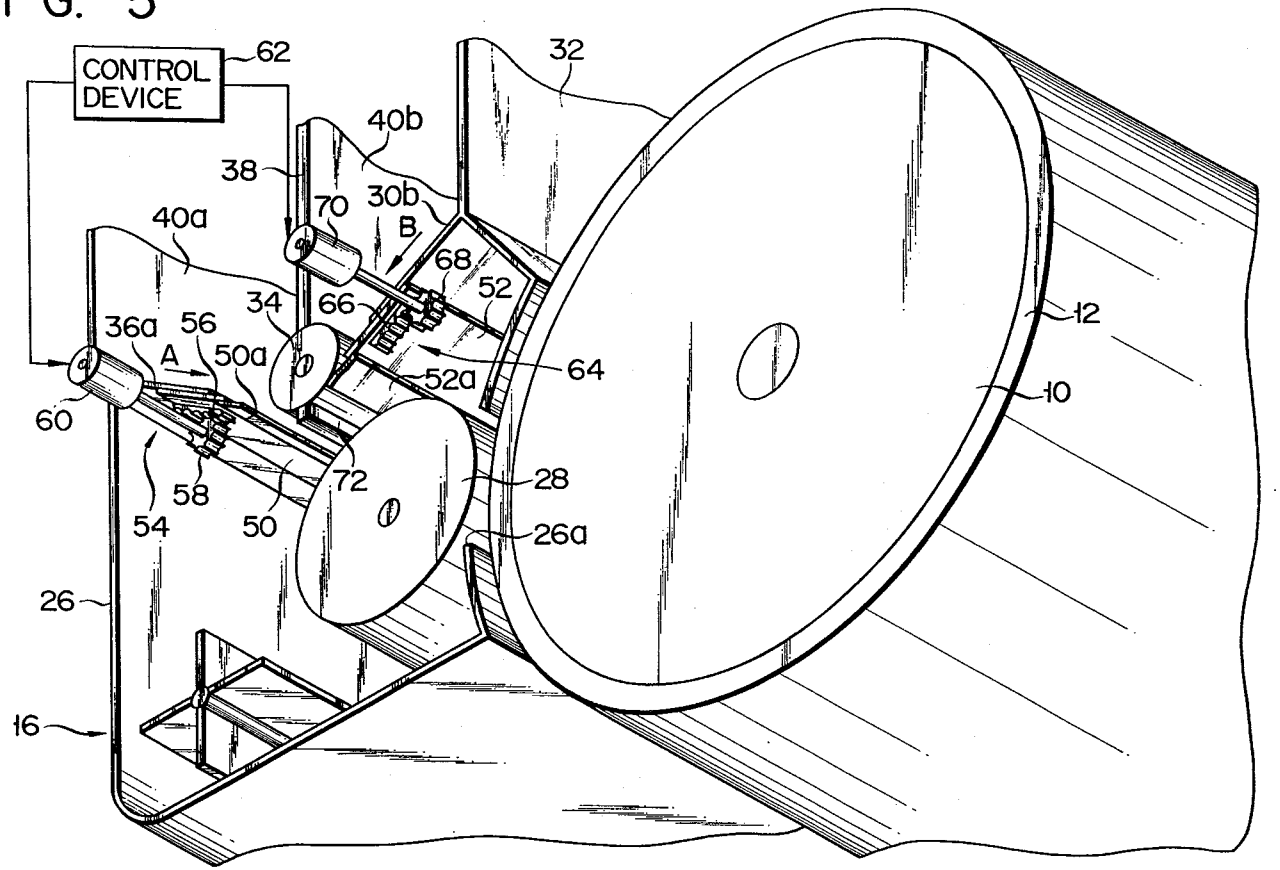
FIG. 5 is a perspective view of the developing device in an operating state different from the state shown in FIG. 2.

The control device 62 controls the time for the start of drive and the rotating direction of the first to third motors 60, 70 and 76 on the basis of detection results from the first and second detecting sections 80 and 82, that is, the detected quantities of the first and second toners 42 and 44. If the detected value given by the first detecting section 80 is lower than a set point, that is, if the quantity of the second toner 44 is reduced, the control device 62 causes the first motor 60 to rotate clockwise thereby moving the first contact strip 50*a* of the first shutter member 50 in the direction indicated by the arrow A so that the first contact strip 50*a* may abut against the outer peripheral surface of the supply roller 34. The control device causes the second motor 70 to rotate clockwise thereby moving the second contact strip 52*a* of the second shutter member 52 in the direction opposite to the direction indicated by the arrow B so that the second contact strip 52*a* may be separated from the outer peripheral surface of the supply roller 34, and it causes the third motor 74 to rotate clockwise thereby causing the supply roller 34 to supply the receptacle 26 selectively with the second toner 44 stored in the second storage chamber 40*b*, as shown in FIG. 2. If the detected value given by the second detecting section 82 is lower than the set point, that is, if the quantity of the first toner 42 is reduced, the control device 62 causes the first motor 60 to rotate counterclockwise thereby moving the first contact strip 50*a* of the first shutter member 50 in the direction opposite to the direction indicated by the arrow A so that the first contact strip 50*a* may be separated from the outer peripheral surface of the supply roller 34. The control device causes the second motor 70 to rotate counterclockwise thereby moving the second contact strip 52*a* of the second shutter member 52 in the direction indicated by the arrow B so that the second contact strip 52*a* may abut against the outer peripheral surface of the supply roller 34, and it causes the third motor 74 to rotate counterclockwise thereby causing the supply roller 34 to supply the receptacle 26 selectively with the first toner 42 stored in the first storage chamber 40*a*, as shown in FIG. 5. The control device 62 also controls the drive of the motors 60, 70 and 76 so that quantity ratio between the first and second toners 42 and 44 is constant.

Inside the receptacle 26, moreover, a stirring vane 106 for uniformly mixing the first and second toners 42 and 44 is arranged so as to be rotated by a drive mechanism (not shown).

In FIGS. 1 and 2, a copying paper conveyor path 108 is provided between the transfer device 18 and the surface of the photosensitive drum 10. Numeral 110 designates an exposure portion of the photosensitive layer 12. A red filter 114 is set in an optical path 112 leading to the exposure portion 110. The red filter 114 can be removed from the optical path 112 as required.

Figures 6A, 6B, 6C, 6D, 6E:
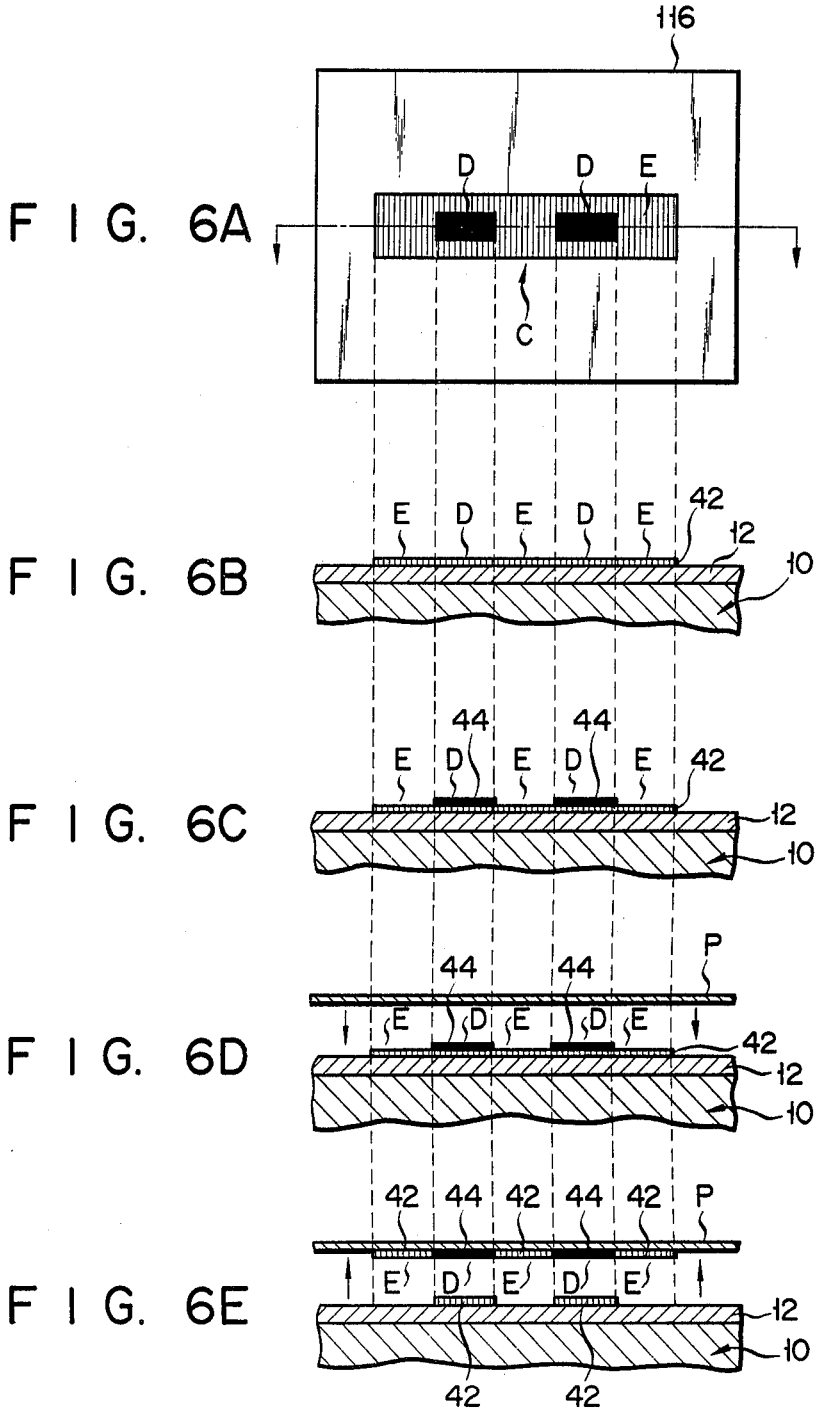
FIG. 6A is a plan view of an original document.
FIGS. 6B to 6E are sectional views for illustrating several transfer processes.

There will now be described how an original paper 116 bearing thereon a pattern C shown in FIG. 6A, for example, is copied with use of the one embodiment of the above-mentioned construction. In FIG. 6A, the pattern C is composed of black portions D and a red portion E.

In a first rotation of the photosensitive drum 10, the charger 14 charges the photosensitive layer 12 with positive electricity. An electrostatic latent image corresponding to the whole pattern C of the document 116 is formed on the exposure portion 110 of the photosensitive layer 12 located between the charger 14 and the developing device 16. Then, the developing roller 28 is rotated counterclockwise, as shown in FIG. 1. In response to such rotation, both the first and second toners 42 and 44 are fed onto the surface of the photosensitive layer 12. In this case, however, only the red first toner 42 with negative charge polarity is adsorbed on the electrostatic latent image on the photosensitive layer 12. Thus, the electrostatic latent image corresponding to the whole pattern C (a picture combining the portions D and E) of the document 116 is developed or actualized all in red, as shown in the sectional view of FIG. 6B.

The portion of the photosensitive drum 10 developed in red passes by the transfer device 18. In the first cycle or rotation, however, the transfer device 18 is prohibited from operating, and no copying paper P is supplied from a paper supply mechanism (not shown). During the first rotation of the photosensitive drum 10, moreover, the cleaning device 20 is off the surface of the photosensitive drum 10. Accordingly, the red first toner 42 forming the red developed picture on the photosensitive drum 10 will not be removed from the surface of the photosensitive drum 10.

When the first development by the red first toner 42 is finished, the photosensitive drum 10 starts a second rotation. In the second rotation of the photosensitive drum 10, the charger 14 charges the photosensitive layer 12 with negative electricity. Electrostatic latent images corresponding to the black portions D of the document 116 are formed on the exposure portion 110 of the photosensitive layer 12. Light for the formation of the electrostatic latent images corresponding only to the black portions D can be obtained by locating the red optical filter 114 in the optical path 112 and transmitting the reflected light from the document 116 through the filter 114. Then, the developing roller 28 is again rotated counterclockwise. In response to such rotation, both the first and second toners 42 and 44 are fed again onto the photosensitive layer 12. In this case, however, only the black second toner 44 with negative charge polarity is adsorbed on the electrostatic latent images on the photosensitive layer 12. Thus, the electrostatic latent images corresponding to the black portions D of the pattern C are developed or actualized in black, as shown in FIG. 6C. The images corresponding to the portions D developed by the black second toner 44 is formed on the images corresponding to the portions D developed by the red first toner 42.

The developed portion of the photosensitive drum 10 passes by the transfer device 18. In the second cycle or rotation, the transfer device 18 operates, and a sheet of copying paper P is supplied from the paper supply mechanism and set in position, as shown in FIG. 6D. Thus, the first and second toners 42 and 44 directly in contact with the copying paper P are transferred onto the paper P, as shown in FIG. 6E. Namely, the black second toner 44 is transferred to the portions of the copying paper P corresponding to the portions D, and the red first toner 42 is transferred to the portion of the copying paper P corresponding to the portion E. In the first rotation of the photosensitive drum 10, the red first toner 42 which has been sticking to the portions of the photosensitive layer 12 corresponding to the portions D is not directly in contact with the copying paper P, so that it remains on the photosensitive layer 12 without being transferred.

The copying paper P to which the pattern C on the original paper 116 has thus been transferred in the two colors, red and black, is led to a fixing device (not shown) through the copying paper conveyor path 108. At the fixing device, the toners 42 and 44 transferred to the copying paper P are fixed thereto. The copying paper P fixed in this manner is taken out of the copying apparatus through a paper outlet, and thus a series of copying processes is completed.

In the second rotation of the photosensitive drum 10, the cleaning device 20 is shifted to the position to abut against the photosensitive layer 12, and the first and second toners 42 and 44 remaining on the photosensitive layer 12 are removed therefrom by the cleaning device 20.

In response to the aforementioned developing operation, the first and second toners 42 and 44 in the receptacle 26 are consumed individually. Since consumption of the first and second toners 42 and 44 is different, the amounts of these toners 42 and 44 remaining in the receptacle 26 are also different. Those residual amounts of the toners 42 and 44 are detected by the detection mechanism 78, and a shortage of the toners 42 and 44 in the receptacle 26 is replenished by the supply mechanism 30.

Thus, the developer supply mechanism 30, comprising the single housing 32, the single supply roller 34, and the single motor 76, can supply the receptacle 26 selectively with the first and second toners 42 and 44. Accordingly, it is unnecessary to provide additional housings, rollers, or motors when the kinds of toners used is increased. Further, the supply mechanism 30 requires only a narrow setting space and hence contributes to miniaturization of the copying apparatus, and the number of components used in the mechanism is reduced lowering the cost. Moreover, since a constant ratio in quantity between the first and second toners 42 and 44 is maintained, picture density may be kept satisfactorily constant.

In the above-mentioned embodiment, color mixture at development is avoided by the use of a developer with positive polarity and one with negative polarity for the first and second developers 42 and 44. Alternatively, however, the color mixture may be avoided by differentiating the specific gravity, particle size, or particle shape (spherical or irregular) between the first and second developers 42 and 44 so that the developers may selectively be supplied by changing the rotating speed of the developing roller 28. Namely, in this case, the heavier, finer, or spherical-particle developer is mainly supplied if the developing roller 28 rotates fast, while the lighter, coarser, or irregular-particle developer is mainly supplied if the developing roller 28 rotates slowly.

Figure 7:
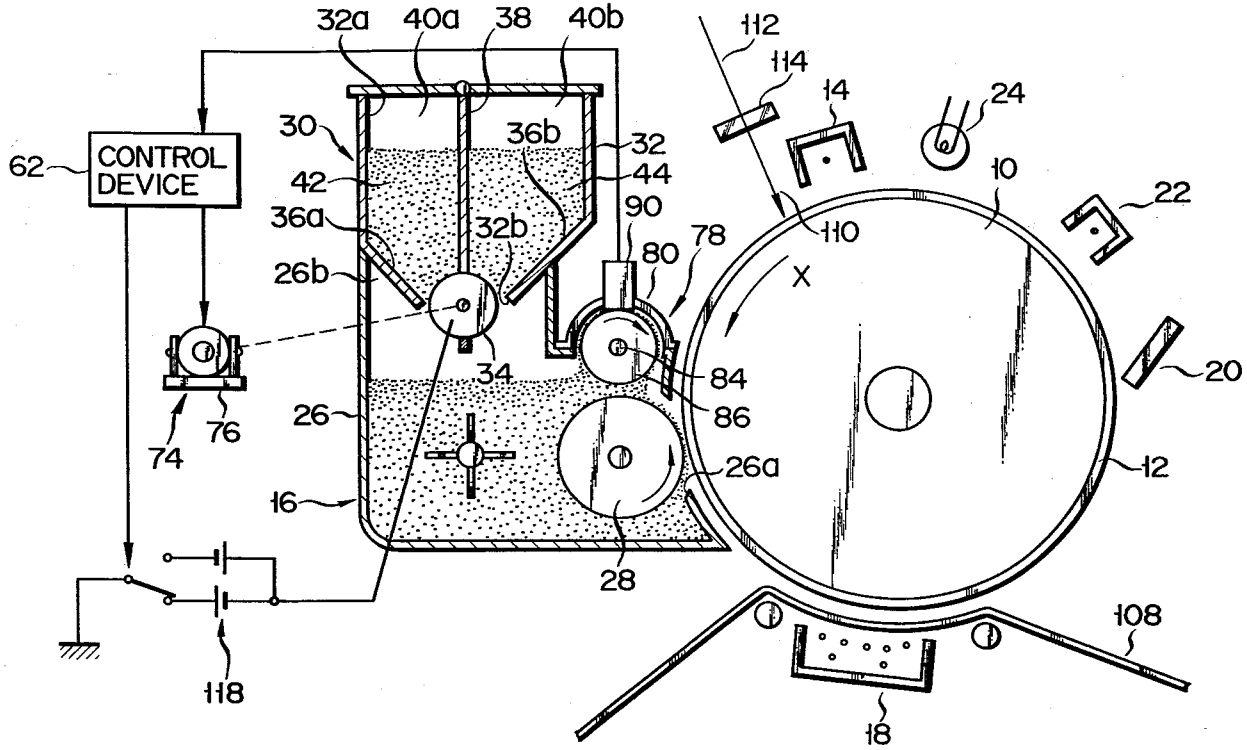
FIG. 7 is a front view of a developing device according to another embodiment of the invention.

In the above embodiment, moreover, the developers 42 and 44 are prevented from dropping by selectively opening and closing the first and second storage chambers **40*a* and 40*b* of the housing 32 of the supply mechanism 30 by means of the first and second shutter members 50, 52, respectively. Having different electric polarities, however, the first and second developers 42 and 44 can be prevented from dropping also by changing the electric polarity applied to the supply roller 34 according to the rotating direction of the roller 34. In this case, as shown as an alternative embodiment in FIG. 7, those developers which are negatively and positively charged when brought into contact with the supply roller 34 are used as the first and second toners 42 and 44, respectively. If the supply roller 34 rotates in the counterclockwise direction of FIG. 7, it is supplied with a positive voltage from an external power source 118, and the first toner 42 contact-charged negatively is adsorbed more firmly on the supply roller 16 to be carried thereby. The second toner 44 contact-charged positively, on the other hand, is urged to leave the supply roller 34 by electric repulsion, and an electric barrier is formed in the gap to prevent the second toner 44 from dropping. If the supply roller 34 rotates clockwise, on the other hand, it is supplied with a negative voltage from the external power source 118 to supply the second toner 44, though the first toner 42** is prevented from dropping.

What is claimed is:

1. A developing device which supplies first and second developers to a photosensitive layer formed on the surface of a photosensitive body, comprising:

a receptacle facing the photosensitive layer to store the first and second developers therein;

supply means in the receptacle for supplying the first and second developers to the photosensitive layer; and developer resupply means attached to the receptacle to replenish selectively the shortage of the first or second developer in the receptacle corresponding to a consumption thereof, said developer resupply means including:

a housing having a connecting port connecting with the receptacle, said housing having first and second storage chambers to store therein the first and second developers, respectively, said first and second storage chambers connected with the connecting port;

a rotating body for resupply rotatably disposed at the connecting port, said rotating body having a first portion located inside the first storage chamber, a second portion located inside the second storage chamber, and a third portion located inside the receptacle; and first drive means connected with the rotating body for driving the rotating body selectively to rotate in one direction or in the other direction opposite thereto, said rotating body supplying the first developer from the first storage chamber to the receptacle when rotated in said one direction, and supplying the second developer from the second storage chamber to the receptacle when rotated in said other direction.

2. The developing device according to claim 1, wherein said developer resupply means includes a blade to come into slide contact with the third portion of the rotating body for resupply, thereby forcing the first or second developer reaching the blade to drop into the receptacle.

3. The developing device according to claim 1, which further comprises detecting means connected with said developer resupply means for detecting the residual amounts of the first and second developers in the receptacle, severally.

4. The developing device according to claim 3, which further comprises control means provided between said detecting means and said developer resupply means, whereby the first drive means causes the rotating body to rotate in said one direction if a detection result from the detecting means indicates that the first developer is less than a set amount, and whereby the first drive means causes the rotating body to rotate in said other direction if the detection result indicates that the second developer is less than the set amount.

5. The developing device according to claim 4, wherein said developer resupply means includes first shutter means capable of opening that portion of the connecting port which connects the first storage chamber, second shutter means capable of opening that portion of the connecting port which connects the second storage chamber, second drive means for driving the first shutter means, and third drive means for driving the second shutter means, and wherein said control means controls the second and third drive means so that the second drive means opens the first shutter means and that the third drive means closes the secod shutter means when the first drive means rotates the rotating body for resupply in said one direction, and controls the second and third drive means so that the second drive means closes the first shutter means and that the third drive means opens the second shutter means when the first drive means rotates the rotating body in said other direction.

6. The developing device according to claim 4, wherein said developer resupply means includes impressing means for selectively impressing said rotating body for resupply positively or negatively, wherein said first and second developers can be charged positively and negatively, respectively, and wherein said control means controls the impressing means so as to charge the rotating body negatively when the first drive means causes the rotating body to rotate in said one direction, and controls the impressing means so as to charge the rotating body positively when the first drive means causes the rotating body to rotate in said other direction.

* * * * *